United States Patent [19]

Lentz

[11] Patent Number: 4,572,156

[45] Date of Patent: Feb. 25, 1986

[54] FIREPLACE SCREEN ASSEMBLY

[75] Inventor: William L. Lentz, Chattanooga, Tenn.

[73] Assignee: De Soto, Inc., Chattanooga, Tenn.

[21] Appl. No.: 654,225

[22] Filed: Sep. 25, 1984

[51] Int. Cl.[4] ..... F24C 15/02

[52] U.S. Cl. ..... 126/140; 49/370; 49/379; 160/DIG. 9; 126/202; 16/DIG. 11

[58] Field of Search ..... 126/138, 139, 140, 202; 160/DIG. 9, 146, 201; 16/DIG. 11; 49/370, 379

[56] References Cited

U.S. PATENT DOCUMENTS

| | | | |
|---|---|---|---|
| 961,578 | 6/1910 | Bitting | 49/379 |
| 1,659,526 | 2/1928 | Harader | 160/DIG. 9 |
| 4,095,582 | 6/1978 | Edwards | 126/140 |
| 4,189,173 | 2/1980 | Rester | 49/449 X |
| 4,512,330 | 4/1985 | Larkins | 126/139 |

FOREIGN PATENT DOCUMENTS

| | | | |
|---|---|---|---|
| 2493480 | 5/1982 | France | 126/202 |

*Primary Examiner*—Margaret A. Focarino

*Attorney, Agent, or Firm*—Dressler, Goldsmith, Shore, Sutker & Milnamow, Ltd.

[57] ABSTRACT

A fireplace screen assembly arrangement is disclosed which includes a frame assembly upon which glass doors and a pair of mesh doors are mounted for slideable lateral movement between closed and open positions with respect to an associated frame assembly and fireplace. The mesh doors are latched in a closed position, and automatically move to lateral full open positions under the influence of a weight and chain mechanism. When the mesh doors are moved to a closed position of rest, a door and frame latching mechanism engages to hold them in that position. In that position, they are ready to open fully when an operator knob is moved to release the latching mechanism. In this manner, convenient use of the fireplace is enhanced, with the mesh door-opening mechanism permitting a user to easily open the mesh doors for gaining access to the fireplace area.

10 Claims, 7 Drawing Figures

FIREPLACE SCREEN ASSEMBLY

TECHNICAL FIELD OF THE INVENTION

The present invention relates generally to fireplace screen assemblies, and, more particularly, to fireplace screen assemblies in which a protective mesh is provided in the form of mesh doors which are readily releasable from a closed locked position of rest to move to a full open position automatically.

BACKGROUND OF THE INVENTION

With continuing concern about energy conservation, there is a desire to minimize the amount of heated air from a dwelling that is permitted to enter a fireplace, hence to minimize room heat loss via a fireplace flue or chimney. Ideally, fireplace screen assemblies close the fireplace opening when the fireplace is not in use. Fireplace screens having a frame on which two or more glass door elements are slidably or hingedly mounted to provide access to the fireplace are therefore increasingly being used to control the draft of air entering the fireplace.

Mesh type screens, such as those of a woven metallic mesh, mounted for opening and closing like sliding doors are frequently provided behind firescreen glass doors to prevent flying sparks from the fireplace from escaping when the doors are open.

One problem with mesh doors is that they must each be hand manipulated separately to gain access to the fireplace hearth area, thus causing some inconvenience to the user and potential danger to the dwelling place if they are left open when the user leaves the area to gather up logs and the like.

SUMMARY OF THE INVENTION

The present invention relates to a fireplace screen assembly having glass doors, and having protective mesh doors which may be readily and automatically opened thereby to provide convenient access to the fireplace area.

The present fireplace screen assembly is adapted to be mounted at the face of a fireplace, and preferably includes a frame assembly, glass doors moveably mounted on the frame assembly for providing access to a fireplace area, and a pair of mesh doors slidably mounted for movement relative to the frame assembly. Means are provided for opening the mesh doors automatically, and include a latch member mounted on each mesh door, a spring latch mounted for relative movement on the frame assembly and normally in engagement with the latch members, operator means accessible from the front of the screen assembly for moving the spring latch out of engagement with the latch member, and means for automatically moving the mesh doors outwardly to full open positions when the operator means moves the spring latch out of engagement with the latch members.

Desireably, each latch member defines a latching surface and the spring latch comprises spring means for biasing the spring latch into engagement with the latching surfaces.

The spring latch may comprise a pair of pins, one pin being spring biased by the spring means into engagement with one of the latching surfaces and the other pin being biased into engagement with the other latching surface. The operator means is mounted to move the spring latch against a further spring from a position in which the pins are in engagement with the latching surfaces to a position in which the pins are elevated and out of engagement with the latching surfaces. Each latch member defines a camming surface adjacent the latching surface and in line with a pin, and biases the pin against the spring means, whereby as a mesh door is moved to a closed position from the fully open position, the pin is displaced until the pin is caused to align with the latching surface, at which time the pin moves from the camming surface into locking engagement with the latching surface.

Preferably, the pins are mounted each for separate movement by spring means relative to an associated camming surface, but for conjoint movement with the spring latch when the operator means is moved.

The automatic means comprises weights secured to the mesh doors for moving the mesh doors to the full open positions when the operator means moves said spring latch out of engagement with latch member. The weights may be secured to the mesh doors by chains, the chains being trained over pulleys mounted on the frame assembly.

Other objects, advantages and features of the present invention will become apparent from the following detailed description of the invention and of a presently preferred embodiment thereof, from the claims, and from the accompanying drawings.

DETAILED DESCRIPTION OF THE PREFERRED EMBODIMENT

Figures 1, 2, 3, 4, 5, 6, 7:
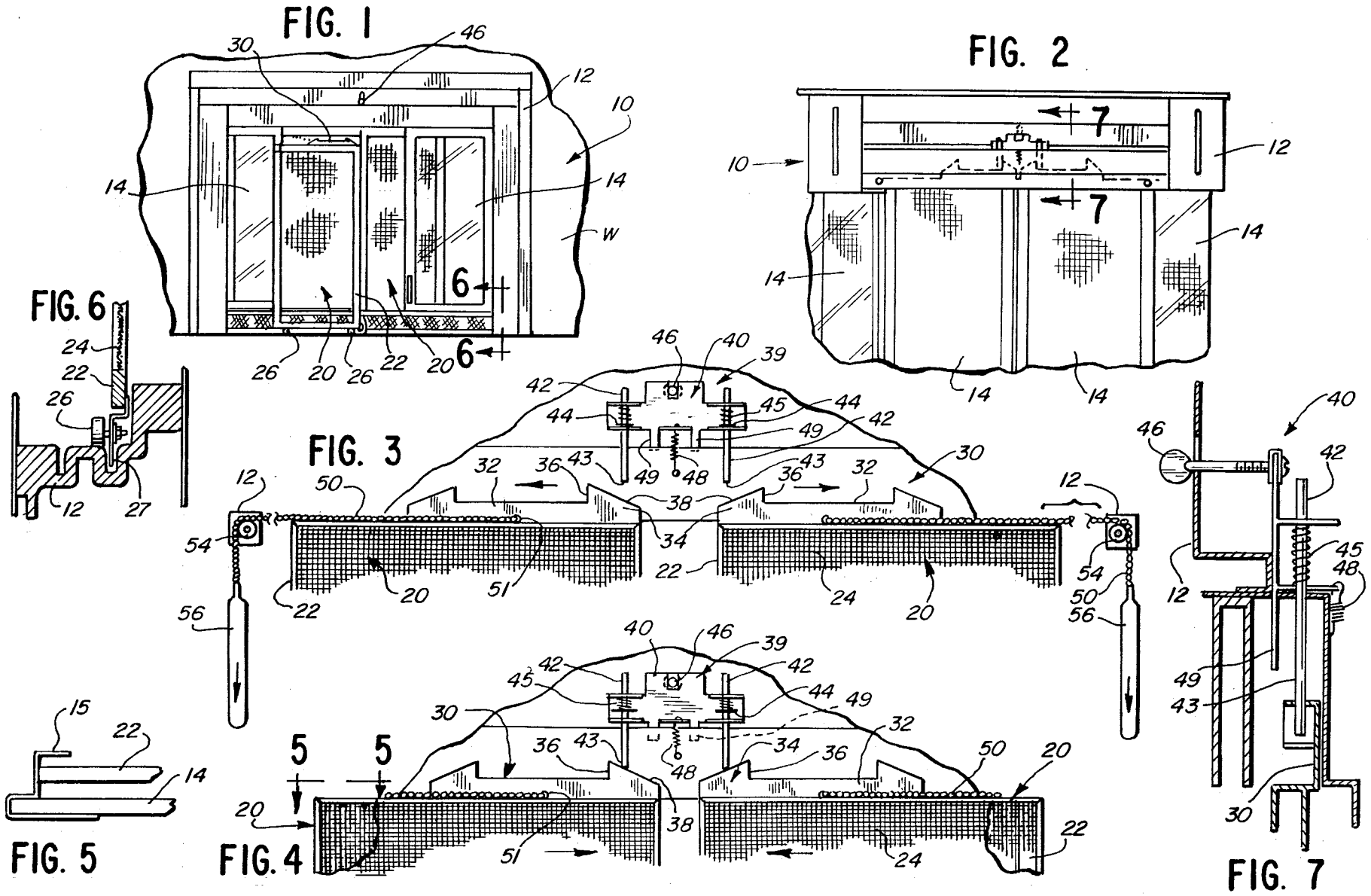
FIG. 1 is a front view of a fireplace screen assembly juxtaposed with a fireplace and embodying the present invention.
FIG. 2 is an enlarged framentary rear view of a portion of the fireplace screen assembly of FIG. 1.
FIG. 3 is an enlarged view of a portion of FIG. 1, showing the mesh doors of the fireplace screen assembly in a position in which they are opening automatically.
FIG. 4 is a view similar to FIG. 3 in which the mesh doors are being manually moved towards a closed, locked position.
FIG. 5 is a view taken substantially along line 5—5 of FIG. 4.
FIG. 6 is a view taken substantially along line 6—6 of FIG. 1.
FIG. 7 is a view taken substantially along line 7—7 of FIG. 2.

While this invention is susceptible of embodiment in many different forms, there is shown in the drawings and described herein in detail one presently preferred embodiment of the invention, with the understanding that the present disclosure is to be considered as an exemplification of the principles of the invention and is not intended to limit the invention to the particular embodiment illustrated.

First referring to FIG. 1, there is shown a fireplace screen assembly 10 that includes a frame assembly 12 on which two pairs of laterally moveable glass doors 14 which may be heat tempered are slidably mounted in a manner well-known to the art. Glass doors 14 may be suspended for rolling movement on the frame assembly 12 in manner typically illustrated in U.S. Pat. No. 4,059,091. Although laterally slidable glass doors are shown, fireplace screen assemblies utilizing moveably mounted doors such as cabinet type doors, or bi-fold glass doors, among others, may be used.

The fireplace screen frame assembly preferably surrounds the fireplace opening and desireably seals against the dwelling wall W around the fireplace opening, thereby to minimize the passage of air around the fireplace screen into the fireplace itself. Depending upon the frame assembly and the surface of the dwelling wall W around the fireplace, sealing materials may be disposed therebetween to enhance the seal. Further, the fireplace screen may be physically secured to the dwelling wall W in front of the fireplace, as by frame brackets which are secured to the underside of a lintel bar, all in a manner known in the art. When a fireplace screen assembly is properly sealed to the dwelling wall, substantially the only air which is admitted to the fireplace itself is that which is permitted to pass into the fireplace through the doors when they are open, or through an associated damper assembly when it is opened. This minimizes the loss of heated air in the winter and air conditioned air in the summer.

In addition to the slidably mounted glass doors 14, protective mesh doors 20 are provided for preventing damage from sparks to the home or furnishings when the glass doors are open. Each mesh door 20 comprises a suitable peripheral frame 22 for holding a mesh 24 which may desirably be a conventional metallic wire mesh or screen. As shown in FIG. 6 and FIG. 1, in which a glass door has been removed and a mesh door 20 has been displaced outwardly to illustrate the rollers 26, doors 20 are slidably mounted on frame assembly 12, as on spaced rollers bearings 26 which roll on suitable portions of the frame assembly 12. The bottoms of the mesh doors mount a flange 27 which travels in a groove defined by the frame assembly at the bottom to resist movement of the mesh doors 20 inwardly and outwardly of the fireplace.

The fireplace screen assembly of the present invention provides for the automatic opening of the slidably mounted mesh doors 20. In addition to the roller bearings 26 and flanges 27 which facilitate rolling movement of the mesh doors on the bottom portion of the frame assembly 12, the tops of each of the mesh doors are provided with a latch member such as a guide 30 which is slidably disposed in a channel associated with the fireplace screen assembly. As shown by the drawings, a guide 30 is secured to each door frame 22. Guides 30 desireably comprise formed sheet metal members. Guide 30 includes a vertical central guide section 32 which is generally flat and which rides in the channel defined by the frame assembly, thereby to guide the upper portion of the mesh door in its lateral movement. Central guide section 32 terminates in an upstanding latch segment 34. Latch segment 34 defines a vertical latching surface or shoulder 36 and an adjacent, intersecting flat flange or cam segment 38.

As best seen in FIGS. 2–4, a spring latch 39 is provided which is engageable with the guides 30. Spring latch 39 may be formed of sheet metal. Spring latch 39 is mounted for vertical movement relative to the frame assembly 12 and comprises a support frame 40 and a pair of latching pins 42. Each latching pin 42 mounts a stop 44. A compression spring 45 is provided and bears against stop 44 and against a flange formed with support frame 40, thereby to bias pin 42 downwardly to a position at which stop 44 bears against a further flange formed with support frame 40. Pin 42 is biased downward sufficiently so that pins 42 are in line with and in engagement with the associated latching shoulders 36, respectively, in a position of rest, thereby to maintain the mesh doors 20 in their closed positions of rest, as illustrated by FIG. 2. Each pin 42 may operate separately and independently under the influence of its associated compression spring 45.

To open the mesh doors 20, the glass doors 14 are first pushed outwardly to their full open positions. The spring latch 39 is then elevated by raising an operator means such as an actuator knob 46. Knob 46 is movable vertically in a slot in frame assembly 12. Knob 46 is also fixed with support frame 40. Support frame 40 is normally biased downwardly by a further spring, a tension spring 48, which is connected at one end to the frame assembly 12 and at the other end to latch 39. As such, the spring latch is normally biased downwardly to the position of FIG. 2. Thus, when knob 46 is elevated, a force sufficient to overcome the force of the tension spring 48 must be applied.

When the actuator knob 46 is lifted sufficiently to elevate the lower ends 43 of the pins 42 from a position in which they are in engagement with the latching surfaces to a position in which they are above and out of engagement with the latching shoulders 36 of the latch members or guides 30, the mesh doors are released and open automatically to their full open positions.

As the spring latch 39 is lifted, the guide fingers 49 which are formed with the spring latch 39 guide the spring latch 39 relative to associated slots in the frame assembly 12. As such, when the spring latch is released, the spring latch 39 will be guided to the position of rest illustrated in Figures 3 and 4.

When the spring latch 39 and associated pins 42 are elevated, the mesh doors open outwardly automatically via a chain and weight mechanism. A pull chain 50 is secured to each of the mesh doors 20. As shown, the ends of the pull chain 50 are disposed in openings 51 in the guides 30 to maintain them in engagement with the doors. Each chain 50 is trained over a pulley 54 which is mounted on the frame assembly 12. The remote end of each chain 50 mounts a weight 56 which is heavy enough to cause the associated mesh door 20 to roll outwardly on the rollers 26. As the mesh doors roll outwardly, the flanges 27 and guides 30 slide between the associated frame assembly members, thereby to maintain the stability of the doors.

In this manner, the simple actuation of actuator knob 46 releases the mesh doors 20 and automatically causes the mesh doors 20 both to open fully and to be retained in their full open positions. Where desired, the mesh doors may travel in the frame assembly in a space provided between the front and back glass doors. Alternatively, they may be disposed in "tracks" behind both front and rear glass doors.

When the mesh doors 20 are to be closed, they may be suitably gripped and moved inwardly against the pull of the weights 56. Alternatively, forwardmost glass doors 14 may be gripped and moved from their open position to their closed positions. As this is done, labyrinth flange 15 (FIG. 5) mounted on the door 14 engages the side edge of frame 22 of mesh door 20 and moves it inwardly against its associated weight 56.

When a mesh door is nearly closed, the flat flange comprising the camming surface of the guide 30, namely a cam segment 38, engages the lower end 43 of a pin 42 and biases the pin independently upwardly against its associated compression spring 45 until the pin reaches its associated latching surface or shoulder 36.

At that time the pin has been displaced fully upwardly and is substantially aligned with the associated latching shoulder. The compression spring 45 then thrusts and moves the respective stop 44 and associated pin downwardly and into locking engagement with the latching surface, thereby locking the mesh door 20 in its closed position of rest.

The compression springs 45 are balanced with tension spring 48 so that they do not overcome the force of the tension spring 48 as either or both of the pins are biased upwardly.

Preferably the glass doors 14 are mounted with the frame assembly 12 so that the labyrinth flange 15 provides a seal to reduce air flow into the fireplace area.

A suitable conventional damper assembly may be desirably positioned at the bottom of the frame assembly, generally centrally of the fireplace screen, and in association with the frame assembly 12. The damper assembly will regulate the amount of air allowed to pass therethrough to the fireplace. Although the damper assembly is typically located at the bottom and centrally of the fireplace screen 10, other locations may be used as well.

From the foregoing, it will be apparent that variations and modifications may be effected without departing from the true spirit and scope of this invention. It is to be understood that no limitation with respect to the specific embodiments illustrated and described herein is intended or should be inferred. It is, of course, intended to cover by the appended claims all such modifications as fall within the scope of the claims.

What is claimed is:

1. A fireplace screen assembly having a frame assembly, glass doors moveably mounted on said frame assembly for providing access to a fireplace area, and a pair of mesh doors having rollers mounted thereon and being slidably mounted for rolling movement relative to said frame assembly, and means for opening said mesh doors automatically, said means for automatically opening said mesh doors comprising, a latch member mounted on each said mesh door comprising a guide portion for guiding said mesh door for sliding movement on said frame assembly, a spring latch mounted for movement on said frame assembly for movement relative to said frame assembly and normally in engagement with said latch members to prevent opening of said mesh doors, operator means accessible from the front of said screen assembly for moving said spring latch out of engagement with said latch member, and weight means secured to said mesh doors for automatically rollingly moving said mesh doors outwardly to full open positions when said operator means moves said spring latch out of engagement with said latch members, and wherein each said latch member defines a latching surface and said spring latch comprises spring means for biasing said spring latch into engagement with said latching surfaces.

2. A fireplace screen assembly in accordance with claim 1, and in which said spring latch comprises a pair of pins, one said pin being spring biased by said spring means into engagement with one of said latching surfaces and the other said pin being spring biased into engagement with the other of said latching surfaces.

3. A fireplace screen assembly in accordance with claim 2, and in which said operator means is mounted to move said spring latch against a further spring from a position in which said pins are in engagement with said latching surfaces to a position in which said pins are out of engagement with said latching surfaces.

4. A fireplace screen assembly in accordance with claim 1, and wherein said weight means are secured to said mesh doors by chains, and said chains are trained over pulleys mounted on said frame assembly.

5. A fireplace screen assembly in accordance with claim 1, and wherein said weight means comprise weights secured to said mesh doors by chains, and said chains are trained over pulleys mounted on said frame assembly.

6. A fireplace screen assembly having a frame assembly, glass doors moveably mounted on said frame assembly for providing access to a fireplace area, and a pair of mesh doors slidably mounted for movement relative to said frame assembly, and means for opening said mesh doors automatically, said means for automatically opening said mesh doors comprising, a latch member mounted on each said mesh door, a spring latch mounted for movement on said frame assembly for movement relative to said frame assembly and normally in engagement with said latch members, operator means accessible from the front of said screen assembly for moving said spring latch out of engagement with said latch member, and means for automatically moving said mesh doors outwardly to full open positions when said operator means moves said spring latch out of engagement with said latch members, and wherein each said latch member defines a latching surface and said spring latch comprises spring means for biasing said spring latch into engagement with said latching surfaces, and each said spring latch comprises a pair of pins, one said pin being spring biased by said spring means into engagement with one of said latching surfaces and the other said pin being spring biased into engagement with the other of said latching surfaces, and wherein each said operator means is mounted to move said spring latch against a further spring from a position in which said pins are in engagement with said latching surfaces to a position in which said pins are out of engagement with said latching surfaces, and wherein each said latch member defines a camming surface adjacent said latching surface and in line with a said pin, and for biasing said pin against said spring means, whereby as a said door is moved to a closed position from said fully open position, said pin is displaced until the pin is caused to align with said latching surface, at which time said pin moves from said camming surface into locking engagement with said latching surface.

7. A fireplace screen assembly in accordance with claim 6, in which said pins are mounted each for separate movement by said spring means relative to an associated camming surface, but for conjoint movement with said spring latch when said operator means is moved.

8. A fireplace screen assembly having a frame assembly, glass doors moveably mounted on said frame assembly for providing access to a fireplace area, and a pair of mesh doors slidably mounted for movement relative to said frame assembly, and means for opening said mesh doors automatically, said means for automatically opening said mesh doors comprising, a latch member mounted on each said mesh door, a spring latch mounted for movement on said frame assembly relative to said frame assembly and normally in engagement with said latch members, operator means accessible from the front of said screen assembly for moving said spring latch out of engagement with said latch member, and weights for automatically moving said mesh doors outwardly to full open positions when said operator means moves said spring latch out of engagement with said latch members, said weights being secured to said mesh doors by chains, and said chains being trained over pulleys mounted on said frame assembly, and wherein each latch member defines a latching surface and said spring latch comprises spring means for biasing said spring latch into engagement with said latching surfaces, said spring latch comprising a pair of pins, one said pin being spring biased by said spring means into engagement with one of said latching surfaces and the other said pin being biased into engagement with the other of said latching surfaces, and wherein said operator means is mounted to move said spring latch against a further spring from a position in which said pins are in engagement with said latching surfaces to a position in which said pins are out of engagement with said latching surfaces, and wherein each said latch member defines a camming surface adjacent said latching surface and in line with a said pin, and for biasing said pin against said spring means, whereby as a said door is moved to a closed position from said fully open position, said pin is displaced until the pin is caused to align with said latching surface, at which time said pin moves from said camming surface into locking engagement with said latching surface.

9. A fireplace screen assembly in accordance with claim 8, in which said pins are mounted each for separate movement by said spring means relative to an associated camming surface, but for conjoint movement with said spring latch when said operator means is moved.

10. A fireplace screen assembly in accordance with claim 9, and wherein said latch member comprises a guide portion for guiding said mesh door for sliding movement on said frame assembly and said mesh doors mount rollers to facilitate sliding movement relative to said frame assembly.

* * * * *